United States Patent [19]

Tera et al.

[11] 4,353,397

[45] Oct. 12, 1982

[54] APPARATUS FOR INSERTING A WEFT ON AN AIR JET LOOM

[75] Inventors: Takumi Tera; Hidetaro Omote, both of Kanazawa; Satoru Kitamura, Matsuto, all of Japan

[73] Assignee: Ishikawa Seisakusho Ltd., Japan

[21] Appl. No.: 148,819

[22] Filed: May 12, 1980

[30] Foreign Application Priority Data

Jun. 1, 1979 [JP] Japan ..... 54-69071

[51] Int. Cl.[3] ..... D03D 47/30

[52] U.S. Cl. ..... 139/435

[58] Field of Search ..... 139/435; 226/97

[56] References Cited

U.S. PATENT DOCUMENTS 3,180,368 4/1965 Kobayashi ..... 139/435
4,125,133 11/1978 Kobayashi et al. ..... 139/435

FOREIGN PATENT DOCUMENTS 2900144 7/1979 Fed. Rep. of Germany ..... 139/435
610366 4/1979 Switzerland ..... 139/435
421278 9/1976 U.S.S.R. ..... 139/435

OTHER PUBLICATIONS

Journal of the Textile Machinery Society, Jul. 1961, pp. 28–36.

*Primary Examiner*—Henry Jaudon
*Attorney, Agent, or Firm*—Ostrolenk, Faber, Gerb & Soffen

[57] ABSTRACT

On an air jet loom, one or more accelerator tubes are arranged in between a main jet nozzle and yarn guides or the like in axial alignment with the main jet nozzle preferably in an axially rotatable fashion in order to increase weft transportation energy of the air flow carrying the weft by sucking ambient air into the accelerator tube. Remarkable increase in travelling speed of the weft under unchanged air pressure or appreciable reduction in power consumption with unchanged travelling speed of the weft can be expected.

15 Claims, 8 Drawing Figures

APPARATUS FOR INSERTING A WEFT ON AN AIR JET LOOM

BACKGROUND OF THE INVENTION

The present invention relates to an apparatus for inserting a weft on an air jet loom.

On an air jet loom, each weft is inserted into open sheds of warps while being entrained on air jet flow ejected by a main nozzle, which runs through an elongated column-shaped spaced defined by yarn guides or particular reeds arranged in the weft direction.

The air ejected by the main jet nozzle diverges into various directions and, consequently, a great deal of weft transportation energy of the air flow is lost on its course to the arrival side of wefts, thereby causing unstable travel of the weft.

Various systems have been proposed in order to mitigate such divergence of the air flow carrying weft.

In one proposal, particular type of reeds are used based on the recognition that a lowering in the flow velocity of the air is caused by leakage of the air out of the open shed of warps. In another proposal, auxiliary jet nozzles are used for supplying additional jet air into the open shed of the warp with the mouths of the nozzles opening in the travelling direction of weft. In yet another proposal, covers are arranged on both vertical sides of the open shed of warps.

Although these conventional systems well stabilize the travelling mode of weft, no increase in the travelling speed of weft can be expected. Conventionally, increase in the travelling speed of weft has been achieved by increasing air pressure at the main jet nozzle, i.e. the velocity of the air flow entraining the weft.

Velocity of the air flow increases to a certain extent in proportion to the corresponding increase in air pressure at the main jet nozzle. However, after reaching a velocity approximately equal to 290 to 300 m/sec, a further increase in air pressure does not accompany a corresponding increase in velocity of the air flow. To the contrary, some reduction in velocity of the air flow tends to occur, and the efficiency of weft transportation energy per power consumption lowers.

This lowering in efficiency is assumed to be caused by the following mechanism.

A main jet nozzle is generally comprised of a main tube and a needle rearwardly coupled to the main tube. The main tube has an axial terminal conduit opening in its front end which faces the warp shed and the needle has an axial yarn guide conduit forwardly communicating with the terminal conduit of the main tube. A forwardly converging throat is left between the main tube and the needle. This throat communicates upstream with a given supply source of compressed air and merges downstream in the terminal conduit of the main tube at the junction of the yarn guide conduit of the needle with the terminal conduit.

The compressed air of a pressure from 1.5 to 4.0 $kg/cm^2$ surges into the terminal conduit via the throat and forms a jet air flow of a velocity from 290 to 300 m/sec. The travelling speed of the weft delivered from the yarn guide conduit of the needle is dependent upon this velocity of the air flow and the length of the terminal conduit formed in the main tube.

Increase in air pressure and the length of the terminal conduit, however, tends to cause the air flow within the terminal conduit to choke, which cuts down the velocity of the air flow and may induce reverse flow of air into the yarn guide conduit of the needle. The combination of these adversely affect stable travel of weft at high travelling speed.

For this reason, there is a critical value for travelling speed of the weft once the mechanical particulars of the apparatus are fixed and it is quite impossible to increase the travelling speed of weft beyond the critical value by increasing air pressure. In order to achieve a further increase in travelling speed of weft, it is necessary to use another main jet nozzle of different mechanical particulars, e.g. a main jet nozzle with a layer diameter of the terminal conduit and higher air pressure. This inevitably leads to the use of an unnecessary large amount of pneumatic energy.

SUMMARY OF THE INVENTION

The basic object of the present invention is to provide an apparatus for inserting weft on an air jet loom which assures stable travel of weft fully across open warp sheds.

Another object of the present invention is to provide an apparatus for inserting weft at remarkably high travelling speed on an air jet loom.

Yet another object of the present invention is to provide an apparatus for inserting a weft with greatly reduced power consumption on an air jet loom.

In accordance with the present invention, an apparatus for inserting a weft on an air jet loom wherein a weft is ejected by a main jet nozzle for weft insertion is characterized in that at least one accelerator tube is arranged between the main jet nozzle and yarn guides or the like substantially in axial alignment with the main jet nozzle while leaving gaps on both longitudinal of the accelerator tube ends.

DESCRIPTION OF THE PREFERRED EMBODIMENTS

Figure 1:
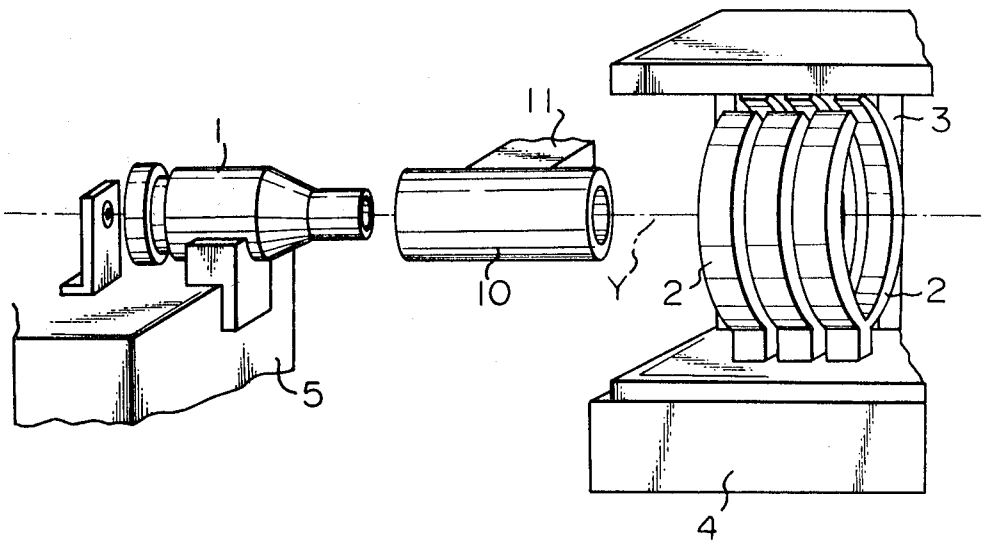
FIG. 1 is a perspective view of one embodiment of the apparatus in accordance with the present invention.

In the following description, like elements in different embodiments are designated with life reference numerals.

A basic embodiment of the apparatus in accordance with the present invention is shown in FIG. 1, in which the apparatus includes a main jet nozzle 1 and an accelerator tube 10. The accelerator tube 10 is arranged, at a position between the main jet nozzle 1 and yarn guides 2 arranged in front of reeds 3 on a lathe 4, substantially in axial alignment with the main jet nozzle 1. The accelerator tube 10 is secured to the framework 5 of the loom by means of a suitable holder arm 11.

The accelerator tube 10 in this embodiment takes the form of a straight tube whose inner diameter should preferably by equal to or larger than that of the main jet nozzle 1, but slightly smaller than that of the yarn guides 2. As a substitute for the yarn guides 2, known types of particular reeds may be used each having a front recess through which inserted wefts advance. In such a case, the inner diameter of the accelerator tube 10 should be slightly smaller than the smallest dimension of the particular reeds.

A used herein, the term "yarn guides" shall refer to conventional yarn guides 2 (as shown), known reeds of the foregoing types and any other equivalent structure for guiding the yarn through the shed.

When the accelerator tube takes a form other than a straight tube in which its inner diameter varies along its length, its inner diameter at the inlet end should preferably be equal to or larger than that of the main jet nozzle 1, but slightly smaller than that of the yarn guides 2 or than the smallest dimension of particular reeds.

In each weft inserting cycle, a weft Y delivered from a given supply source (not shown) is fed to the main jet nozzle 1 and is inserted into the open shed via the accelerator tube 10 and the yarn guides 2 while being entrained on a jet flow ejected by the main jet nozzle 1.

Operation of the accelerator tube 10 in accordance with the present invention is as follows, reference being made to FIG. 2.

Assuming that the inner diameter of the main jet nozzle 1 is equal to "d", the air ejected from the main jet nozzle 1 retains its initial flow velocity at the outlet of the main nozzle 1 within a conical ambit whose apex fall on a point P distant from the outlet of the main jet nozzle 1 by a distance of 3*d* to 5*d*. This ambit is shown with solid lines in the illustration. Outside this conical ambit, the air diverges with an angle of divergence approximately equal to 12.5 degrees and abruptly loses its initial flow velocity due to mixing with ambient air. This divergence is shown with chain lines in the illustration. The apex of the conical ambit may be located at a point a bit more distant from the outlet of the main jet nozzle by increasing the air pressure to be fed to the main nozzle. However, such increase in air pressure cannot substantially avoid the above-described divergence of the ejected air.

As a consequence, the travelling speed of the inserted weft is dependent upon the initial velocity of the air ejected from the main jet nozzle 1 only when the main jet nozzle 1 is accompanied with no intermediate accelerator tube. In connection with this, however, there is a certain limit to the increase in initial velocity of the air to be resulted from increase in air pressure at the main jet nozzle 1 due to choking of the air flow within the main jet nozzle 1.

By interposing the accelerator tube 10 between the main jet nozzle 1 and the yarn guides 2 in accordance with the present invention, the air just on the verge of divergence is caught by the inlet end section of the accelerator tube 10 and guided thereinto in order to advance along the inner surface of the accelerator tube 10. Due to presence of a relatively small gap between the main jet nozzle 1 and the accelerator tube 10, the air ejected from the main jet nozzle 1 and flowing into the accelerator tube 10 has a sort of aspirator effect and generates negative pressure in the vicinity of the intermediate gap. Consequently, the ejected air accompanies ambient air when it flows into the accelerator tube 10 and the increase in flow rate provides corresponding increase in weft transportation energy, which advances, with appreciable acceleration, the weft towards the yarn guides 2 via the accelerator tube 10. The travelling speed of the weft in accordance with the present invention can therefore be substantially increased with respect to that achieved with the conventional apparatus without use of the accelerator tube. This effect of the present invention just corresponds to an effect which could be obtained by elongating the main jet nozzle in the prior art without causing the air flow to choke.

The increased flow rate in the accelerator tube results in stabilized travel of the weft through the open shed.

In order to obtain a further enriched effect of the invention, suitable known type of smoothing treatment may advantageously be applied to the inner surface of the accelerator tube 10. Application of such a treatment well contributes to increase in flow velocity of the air, i.e. travelling speed of the weft.

Figure 3:
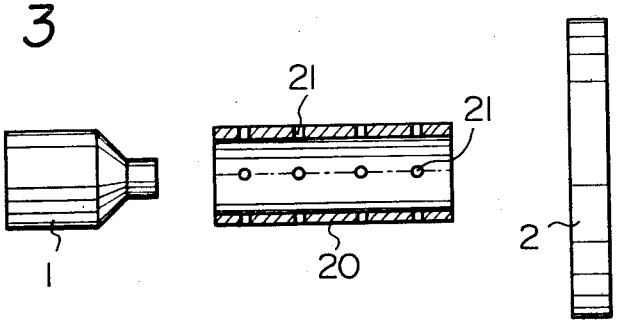

Another embodiment of the apparatus in according with the present invention is shown in FIG. 3, in which the apparatus includes a main jet nozzle 1 and an accelerator tube 20 arranged between the main jet nozzle 1 and yarn guides 2 substantially in axial alignmet with the main jet nozzle 1. The accelerator tube 20 of this embodiment is provided with a number of radial through holes 21.

Due to presence of such holes, air ejected from the main jet nozzle 1 and impinging upon the inner surface of the accelerator tube 20 partly flows outside the accelerator tube 20 via the holes 21, thereby mitigating occurance of turbulence in the vicinity of the inner surface in order to further accelerate and stabilize the air flow exiting of the accelerator tube 20.

Figure 4:
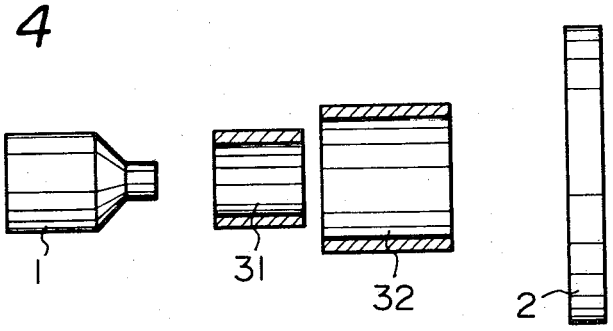
Figure 5:
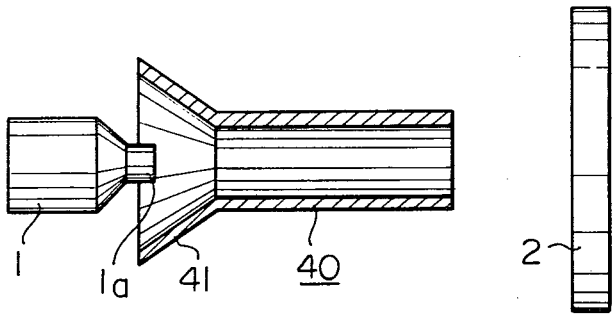

Another embodiment of the apparatus in accordance with the present invention is shown in FIG. 4, in which the apparatus includes a main jet nozzle 1 and a pair of accelerator tubes 31 and 32 arranged between the main jet nozzle 1 and yarn guides 2 substantially in axial alignment with the main jet nozzle 1. The accelerator tubes 31 and 32 are spaced apart from each other along the travelling path of wefts. The accelerator tube 31 closer to the main jet nozzle 1 is smaller in diameter and the accelerator tube 32 closer to the yarn guides 2 is larger in diameter.

When a single relatively long intermediate tube only is used for acceleration of the ejected air, flow resistance by the inner surface of the tube may cause a choking of the air flow in the vicinity of the surface due to impact wave and such a choking is assumed to more or less cut down the flow velocity of the air. In accordance with this embodiment, the presence of a gap between the two accelerator tubes 31 and 32 enables ambient air to be sucked into the second tube 32 in order to increase flow rate in the second tube, thereby raising the flow velocity of the air going out of the second accelerator tube 32.

A further embodiment of the apparatus in accordance with the present invention is shown in FIG. 1, in which the apparatus includes a main jet nozzle 1 and an accelerator tube 40 arranged between the main jet nozzle 1 and yarn guides 2 substantially in axial alignment with the main jet nozzle 1. The accelerator tube 40 of the embodiment is provided, on its inlet side, with a funnel shaped mouth 41 encompassing the outlet end 1*a* of the main jet nozzle 1. The presence of the funnel shaped mouth 41 assures reliable seizure of the diverging air ejected from the main jet nozzle and increased suction of the ambient air into the accelerator tube 40, thereby appreciably increasing the flow rate of the air through the accelerator tube 40.

Figure 6:
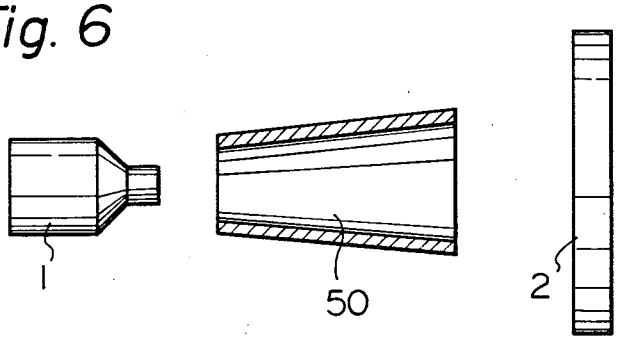

A further embodiment of the apparatus in accordance with the present invention is shown in FIG. 6, which includes an accelerator tube 50. The inner diameter of the accelerator tube 50 increases continuously from the inlet to the outlet.

Figure 8:
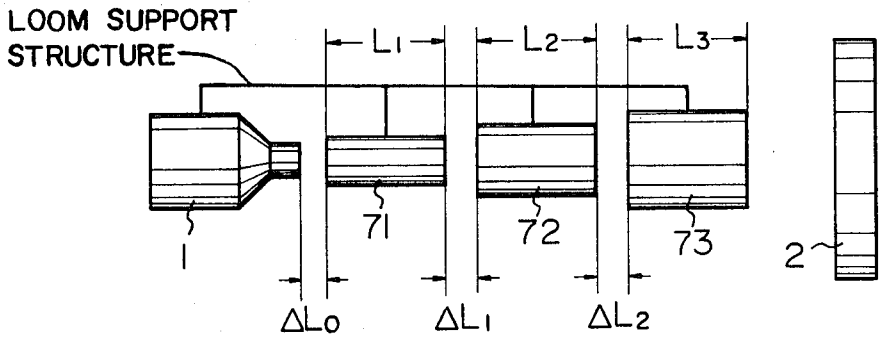
FIG. 8 is a side view for explaining the relationship in dimension of the apparatus in accordance with the present invention.

A still further embodiment of the apparatus in accordance with the present invention is shown in FIG. 8, which includes an accelerator tube 60. The inner diameter of the accelerator tube 60 increases stepwise from the inlet to the outlet.

The relationships in dimension between elements used in the present invention is as follows, assuming a case in which three sets of straight accelerator tubes 71 through 73 are arranged between a main jet nozzle 1 and yarn guides 2 as shown in FIG. 8. It is further assumed that the tubes 71 through 73 have inner diameters $D_1$ through $D_3$ which suffice the following relationship, the inner diameter of the acceleration conduit in the main jet nozzle 1 being equal to $D_0$:

$$D_0 \leqq D_1 < D_2 < D_3$$

Under this condition, higher acceleration effect is obtained as the ratio $D_{n+1}/D_n$ (n=0, 1, 2, 3) approaches 1. In practice, however, the ratio $D_{n+1}/D_n$ should preferably be in a range from 1.1 to 1.2.

Optimum lengths $L_1$ through $L_3$ of the accelerator tubes 71 through 73 are fixed in reference to their inner diameters $D_1$ through $D_3$. The maximum inner diameter of the accelerator tube should be about 12 mm in view of the inner diameter of the existing yarn guide. Under the condition that the maximum inner diameter of the accelerator tube is smaller than 12 mm, the length of each accelerator tube should preferably be in a range from 10 mm to 70 mm. When the length falls short of 10 mm., no appreciable suction of the ambient air into the acceleration tube can be expected. Lengths exceeding 70 mm, tend to generate turbulence near the inner surface of the accelerator tube.

The total length of the accelerator tubes should preferably be smaller than 300 mm, and more preferably be about 200 mm.

The lengths of the gaps $\Delta L_0$ through $\Delta L_2$ between adjacent accelerator tubes should be designed in consideration of each rate of air divergence between the adjacent tubes concerned in order to fully seize air diverging at an angle of 6°28'. More specifically, the following relationship should preferably be satisfied.

$$\frac{D_{n+1} - D_n}{2\,\Delta\,L_n} < \tan 6°28'$$

In practice, however, the lenth of each gap $\Delta L$ should preferably be 5 mm or smaller.

EXAMPLE

Polyester strechable bulky yarns of 75d/36f thickness were processed under various conditions on weaving looms equipped with the weft inserting apparatus in accordance with the present invention and the conventional weft inserting apparatus, respectively. The inner diameter of the main jet nozzle was 2.7 mm, the inner diameter of the yarn guide was 14 mm, and the gap $\Delta L_o$ between the main jet nozzle and the first, i.e. chosest, accelerator tube was 3mm. Smoothening treatment was applied to the inner surface of the tubes. The results of the tests are shown in the following table with the inner surface of the tubes.

The results of the tests are shown in the following table with the process conditions.

Figure 2:
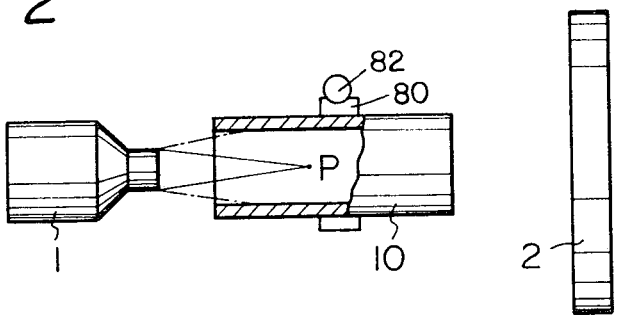
FIG. 2 to 7 are side views, partly in section, of various embodiments of the apparatus in accordance with the present invention.
Figure 7:
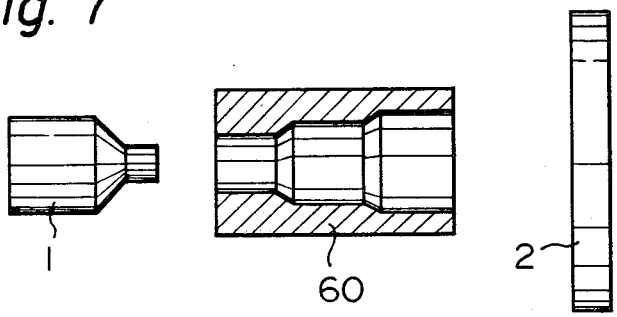

| Test | I | II | | III | | IV | V | VI | VII |
|---|---|---|---|---|---|---|---|---|---|
| Number of accelerator tubes used | 1 | 2 | | 2 | | 1 | 1 | 1 | 0 |
| Type of the accelerator tube | FIG. 1 | FIG. 1 | | FIG. 4 | | FIG. 2 | FIG. 6 | FIG. 7 | |
| Inner diameter of the tubes in m.m. | 4 | 4 | 4 | 4 | 6 | 4 | * | ** | |
| Tube Lengths in mm. | 150 | 150 | 150 | 100 | 50 | 150 | 100 | 50 × 3 | |
| Travelling speed of weft in m/sec. | 40 | 45 | | 53 | | 50 | 43 | 48 | 34 |

*inlet end 4
outlet end 6
**inlet section 4
middle section 5
outlet section 6

The results given in the table clearly indicates that use of the accelerator tube in accordance with the present assures appreciable increase in travelling speed of the yarn at weft insertion.

Although the accelerator tube or tubes of the foregoing embodiments are fixed to the framework of the loom as shown in FIG. 1, they may be supported by the framework for axial rotation. To this end, the accelerator tube may be provided with an outer annular gear 80 (see FIG. 2) in meshing engagement with a drive gear 82 operationally coupled to a suitable drive source on the loom. It was also confirmed by tests conducted by the inventors that rotation of the accelerator tube enables a further 3 to 5 m/sec increase in travelling speed of the yarn at weft insertion.

As is clear from the foregoing description, simple use of at least one acceleration tube in accordance with the present invention enables remarkable increase in yarn travelling speed at weft insertion by 20 to 60 percent using a common main jet nozzle with no rise in the air pressure. In other words, when there is no need for raising the yarn travelling speed, the corresponding air pressure can be lowered, thereby greatly saving power consumption.

We claim:

1. Apparatus for inserting a weft through a warp shed of an air jet loom, comprising:

a main jet nozzle through which a weft is propelled under the force of a jet of air;

yarn guides located in said shed;

an accelerator tube located between said main jet nozzle and said yarn guides but outside of said shed, said accelerator tube having an opening extending in the direction of travel of said weft as it travels from said main jet nozzle to said shed, the length of said opening extending from an inlet end to an outlet end of said tube, said inlet end of said tube being closer to said main jet nozzle than said outlet end and being spaced from said main jet nozzle by a gap, the distance of said gap as measured along said direction of travel and the inner diameter of said accelerator tube inlet opening being such that a negative pressure is created in the vicinity of said gap and ambient air is sucked into said accelerator tube through said first end thereof with the resultant effect that increased weft transportation energy is applied to said weft and said weft travels toward said shed at a velocity which is greater than that which would be achieved if said accelerator tube were not employed.

2. An apparatus as claimed in claim 1, further including means for fixedly supporting said accelerator tube to a framework of said loom.

3. An apparatus as claimed in claim 1, further including means for rotating said accelerator tube about its own longitudinal axis.

4. An apparatus as claimed in claim 1, 2 or 3, characterized in that:

the inner diameter of said accelerator tube at its inlet end is equal to or larger than the inner diameter of said main jet nozzle at its outlet end; and the inner diameter of said accelerator tube at its outlet end is smaller than the inner diameter of said yarn guides.

5. An apparatus as claimed in claim 1, 2 or 3, characterized in that said accelerator tube takes the form of a straight tube.

6. An apparatus as clained in claim 5, wherein said accelerator tube is a first accelerator tube and wherein said apparatus further includes a second accelerator tube located between said first accelerator tube and said shed, an inlet end of said second accelerator tube being spaced from said outlet end of said first accelerator tube by a second gap; and the inner diameter of said second accelerator tube being smaller than that of said first accelerator tube.

7. An apparatus as claimed in claim 6, characterized in that the ratio of said inner diameter of said second accelerator tube to that of said first accelerator tube is in a range from 1.1 to 1.2.

8. An apparatus as claimed in claim 7, characterized in that said second gap satisfies the following relationship:

$$\frac{D_{n+1} - D_n}{2\,L_n} < \tan 6°28'$$

wherein $D_{n+1}$ is the inner diameter of said second accelerator tube, $D_n$ is the inner diameter of said first accelerator tube and $L_n$ is the length of said second gap.

9. An apparatus as claimed in claim 1, 2 or 3, characterized in that said accelerator tube has a number of radial through holes formed therein.

10. An apparatus as claimed in claim 1, 2 or 3, characterized in that said main jet nozzle has a nose through which said weft exits and said accelerator tube has a funnel shaped mouth extending from said inlet opening toward said main jet nozzle and encompassing said nose of said main jet nozzle.

11. An apparatus as claimed in claim 1, 2 or 3, characterized in that the inner diameter of said accelerator tube increases continuously from said inlet end to said outlet end of said accelerator tube.

12. An apparatus as claimed in claim 1, 2 or 3, characterized in that the inner diameter of said accelerator tube increases stepwise from said inlet to said outlet end of said accelerator tube.

13. The apparatus of claim 1, wherein said inner diameter of said accelerator tube opening is smaller than 12 mm and said length of said opening is between 10 and 70 mm.

14. The apparatus of claim 13, wherein said distance of said gap is between 3 and 5 mm.

15. The apparatus of claim 1, wherein said weft leaves said main jet nozzle through a weft opening thereof and along a predetermined axis and wherein said opening of said accelerator tube at said inlet end completely encompasses a cone extending from said weft opening of said main jet nozzle at an angle of 6° 28′ from said predetermined axis.

* * * * *